US005293913A

United States Patent [19]

Preszler

[11] Patent Number: 5,293,913

[45] Date of Patent: Mar. 15, 1994

[54] BOTTLE KEYING SYSTEM

[75] Inventor: Duane A. Preszler, River Falls, Wis.

[73] Assignee: Minnesota Mining and Manufacturing Company, St. Paul, Minn.

[21] Appl. No.: 71,219

[22] Filed: May 27, 1993

Related U.S. Application Data

[63] Continuation of Ser. No. 729,369, Jul. 12, 1991, abandoned.

[51] Int. Cl.[5] ..... G03G 15/00

[52] U.S. Cl. ..... 141/367; 141/100; 141/104; 141/312; 141/329; 141/346; 141/364; 355/260; 285/27; 285/93; 346/140 R

[58] Field of Search ..... 141/100, 104, 231, 312, 141/329, 330, 363-366, 367, 346, 94; 285/25-28, 93; 137/360; 355/260; 222/DIG. 1; 346/140 R

[56] References Cited

U.S. PATENT DOCUMENTS

| | | | |
|---|---|---|---|
| 3,287,031 | 11/1966 | Simmons et al. | 285/27 |
| 3,563,267 | 2/1971 | Thompson | 137/360 X |
| 3,651,782 | 3/1972 | MacDonald, Jr. | 355/260 X |
| 3,973,699 | 8/1976 | Cook | 222/DIG. 1 |
| 4,211,439 | 7/1980 | Moldestad | 285/27 |
| 4,527,700 | 7/1985 | Jupin et al. | 215/32 |
| 4,718,699 | 1/1988 | Kulish et al. | 285/93 X |
| 4,740,808 | 4/1988 | Kasamura et al. | 355/260 |
| 4,853,708 | 8/1989 | Walters | 346/75 |
| 4,854,459 | 8/1989 | DeJonge | 215/220 |
| 4,860,050 | 8/1989 | Kurotori et al. | 355/260 X |
| 4,907,019 | 3/1990 | Stephens | 141/367 X |
| 4,990,964 | 2/1991 | Kraehn | 355/260 |
| 4,991,730 | 2/1991 | Pehr | 215/215 |
| 5,040,024 | 8/1991 | Fukuda et al. | 222/DIG. 1 |

FOREIGN PATENT DOCUMENTS

| | | | |
|---|---|---|---|
| 2413604 | 7/1979 | France . | |
| 61-180158 | 8/1986 | Japan . | |
| 2-310572 | 12/1990 | Japan | 355/260 |
| 2116274 | 9/1983 | United Kingdom | 285/27 |

OTHER PUBLICATIONS

European Search Report, Apr. 7, 1993.

*Primary Examiner*—J. Casimer Jacyna
*Attorney, Agent, or Firm*—Gary L. Griswold; Walter N. Kirn; Charles D. Levine

[57] ABSTRACT

The system ensures the proper placement of bottles which deliver material to a system. The system prevents male components from being mounted on incorrect female components. The male components can be tubes, and the female components can be covers which fit on the openings of bottles. A first key is formed on a first male component and a complementarily-shaped first keyway is formed on a first female component. Additional male and female component pairs have similar key-keyway pairs. Each key and each keyway includes first and second projections. The first projection is located in a reference position, and the second projection is located a predetermined distance from the reference position. This distance for each component pair is selected to identify the particular component pair.

6 Claims, 3 Drawing Sheets

BOTTLE KEYING SYSTEM

This is a continuation of application Ser. No. 07/729,369, filed Jul. 12, 1991, now abandoned.

TECHNICAL FIELD

The present invention relates to bottles which deliver material to a system such as electrophotographic printers. More particularly, the present invention relates to a system for insuring the proper placement of bottles which deliver material to a system such as electrophotographic printers.

BACKGROUND OF THE INVENTION

Electrophotographic printers, such as digital proofing and other printing machines produce single color or multicolored prints of an original document. A photoconductor film secured to a carrier member is first charged to a uniform potential to sensitize its imaging surface. The charged surface of the photoconductor film is exposed to an image of the original document, and records an electrostatic latent image corresponding to the informational areas contained within the image of the original document. The latent image is developed with liquid toners or inks. This imaging process may be repeated for each process color, with the images sequentially recorded on the photoconductor film. Typically, magenta, cyan, yellow, and black inks are the four standard colors, and additional special colors also may be used. The developed image is transferred from the photoconductor film to a print medium. Heat and pressure permanently transfer the image to the print medium to complete the process.

Generally, both a concentrate and a replenisher ink in each color is required. Each color has its own tank, valves, plumbing, and developer. If the wrong color ink is installed into a plumbing system, the machine will not print properly and long down-time periods in the field result.

Color coded keying systems for preventing the mismatching of components is well known. However, color coding can not prevent mismatched components from being placed together.

Key and keyway systems also are well known. These systems are commonly known to lock caps on containers such as with drug containers to prevent easy opening. These systems also are used to maintain a proper alignment between two components. Some examples of these systems are disclosed in U.S. Pat. No. 4,991,730 to Pehr, U.S. Pat. No. 4,854,459 to DeJonge, and U.S. Pat. No. 4,527,700 to Jupin et al. However, while these systems are known to secure together or align two components, their use for preventing the joining of two components is not documented. As discussed above, there is a need for a key-keyway system to prevent the connecting of improper components such as ink bottles to ink plumbing systems.

SUMMARY OF THE INVENTION

The system of the present invention ensures the proper placement of inks into the proper plumbing system of printers such as electrophotographic machines. Placing the wrong bottle on the wrong receptacle is no longer possible. The system is used with printers that require a plurality of similarly shaped male tubes to be mounted on and received in specific female bottle openings and prevents the tubes from being mounted on incorrect bottle openings. The bottle openings can be formed in covers which fit on the bottles.

A mechanical keying system prevents the inks from being loaded into the wrong color plumbing system. The keying system includes unique keyed bottle covers for each color. The keyed covers match keyed replenisher and concentrate tubes in the writer. Different keys are formed on the tubes and complementarily-shaped keyways are formed on the keyed cover for the bottle. A first key and keyway are formed on a first tube-keyed cover pair which involves magenta ink. A second key and keyway are formed on a second tube-keyed cover pair which involves cyan ink. Third and fourth keys and keyways are formed on third and fourth tube-keyed cover pairs which involve yellow and black ink. Additional tube-keyed cover pairs are used for additional special inks, where used.

Each key and each keyway include first and second projections extending from a circular shape. The first projection is located in a reference position which is identical in all keys and keyways. The second projection is located a predetermined rotational distance from the reference position. This distance for each tube-keyed cover pair is selected to identify the particular tube-keyed cover pair. The second projection on any tube-keyed cover pair is located a multiple of 45° from the location of the first projection as well as the second projection on any other tube-keyed cover pair. The first projection is larger than the second projection.

DETAILED DESCRIPTION OF PREFERRED EMBODIMENTS

Figure 1:
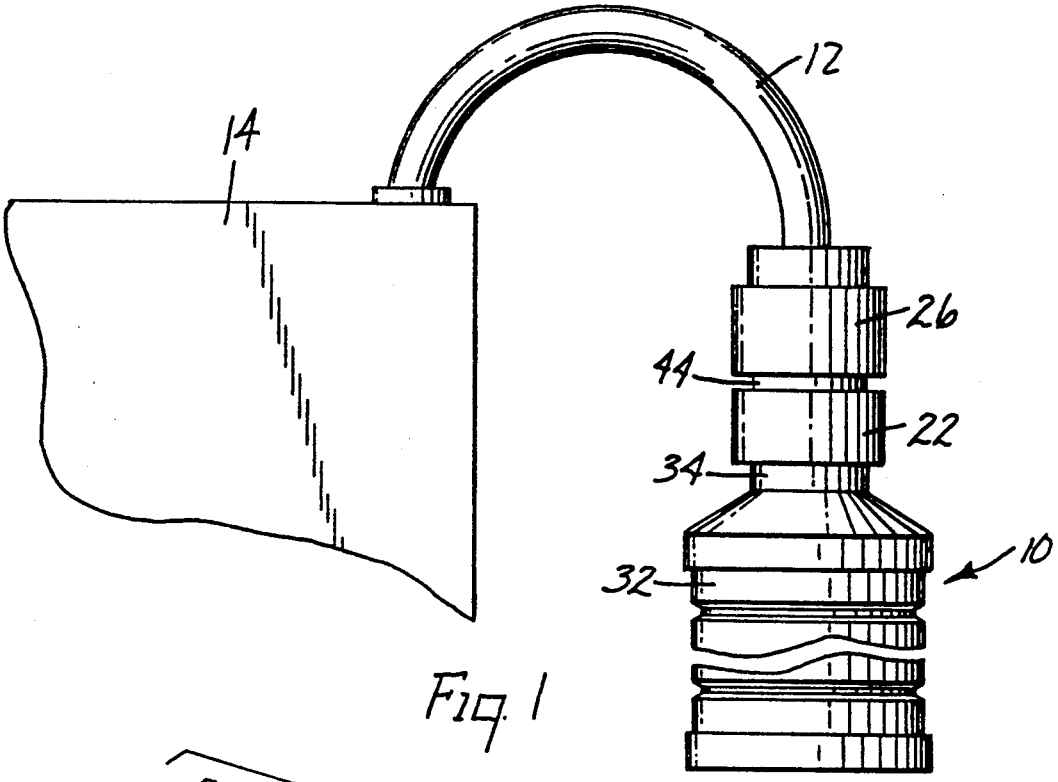
FIG. 1 is a side view of the bottle keying system of the present invention, showing the system used with replenisher bottles.

The system of the present invention ensures the proper placement of inks into the proper plumbing system of printers such as electrophotographic machines and high resolution digital proofing machines. These printers use magenta, cyan, yellow, and black inks and sometimes use additional special colors. Generally, both a concentrate and a replenisher ink in each color is required. Each color has its own tank, valves, plumbing system, and developer. If the wrong color ink is installed into a plumbing system, the machine will not print properly, and the entire developer system must be replaced, resulting in high repair costs and long down-time periods.

To dispense the ink, these machines require a plurality of similarly-shaped replenisher bottles 10, or other containers, which are connected to a replenisher tube 12 which leads into the tank 14. The replenisher bottles 10 dispense ink into the ink tank 14 during printing to replenish and regulate the density of the ink supply. Additionally, a plurality of similarly-shaped concentrate bottles 16, or other containers, dispense ink into the tank 14 through a concentrate tube 18 at the beginning of printing. A mechanical keying system 20 prevents the bottles 10, 16 from being loaded into the wrong color plumbing system by keying each replenisher bottle 10 and concentrate bottle 16 to accept the proper matching replenisher tube 12 and concentrate tube 18. The keying system 20 includes unique keyed bottle covers 22 for each color which match keyed replenisher and concentrate tubes 12, 18 in the plumbing system.

Figure 2:
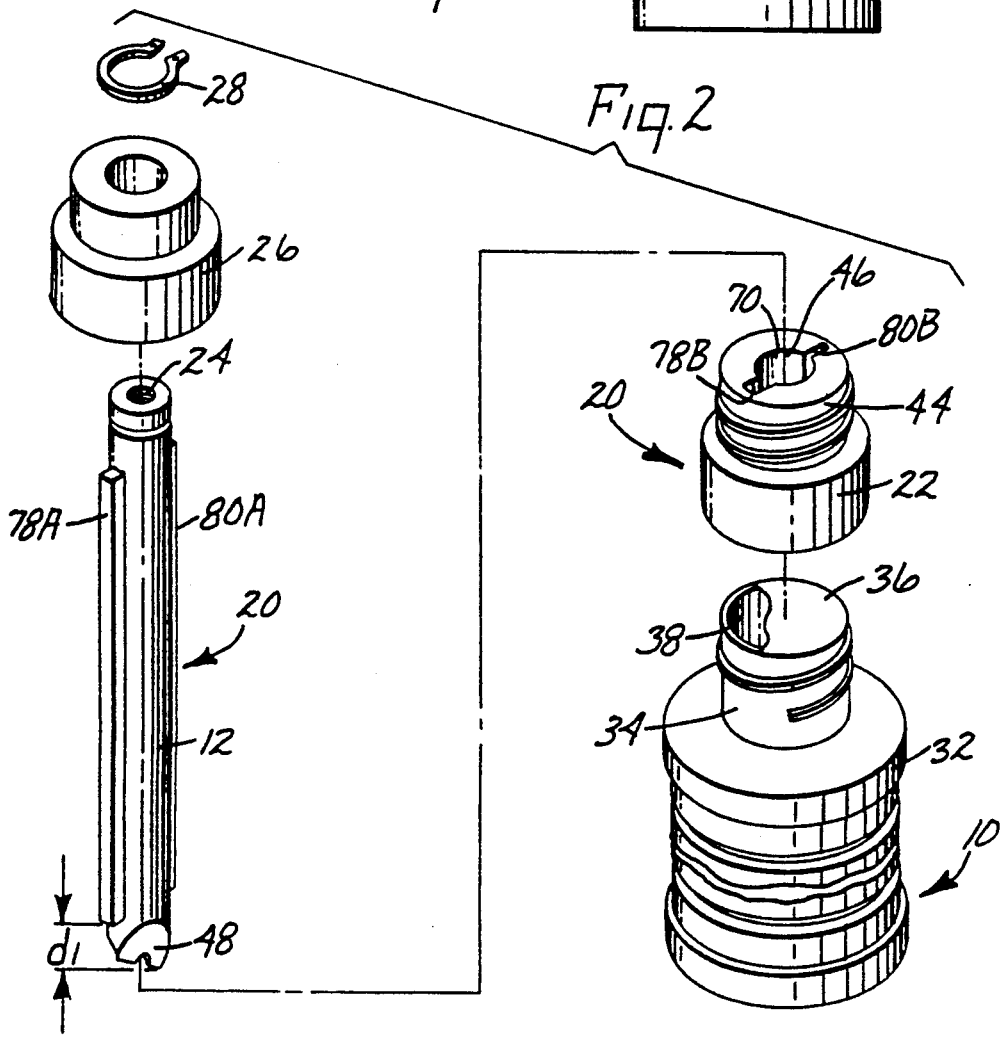
FIG. 2 is an exploded isometric view of the bottle keying system of FIG. 1.

Turning first to the replenisher system, as shown in FIGS. 1 and 2, the replenisher tube 12 extends from and communicates with the tank 14. The replenisher tube 12 has a small orifice 24 to prevent air from entering the lines and degrading the print quality when the replenisher bottles 10 are replaced. A circular fitting 26 is held in place on the replenisher tube 12 by a retaining ring 28. The fitting 26 has internal screw threads 30 (see FIG. 4). The replenisher bottle 10 includes a body 32 and a neck 34 and is filled with ink. A sealing foil 36 is placed across the opening 38 at the top of the neck 34. The foil 36 prevents contamination of the ink within the replenisher bottle 10 and leakage of ink from the bottle 10 before the bottle 10 is used.

Figure 7:
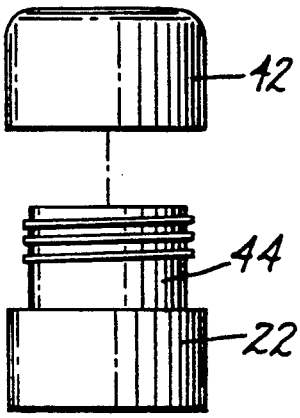
FIG. 7 is a side view of a protective cover for the keyed bottle covers of the present invention.

The keyed cover 22 is placed on and becomes an integral part of the neck 34 of the replenisher bottle 10 such that the keyed cover 22 can not be removed. The keyed cover 22 has screw threads 40 (see FIG. 4) for further securing the cover 22 onto the threaded neck 34 of the replenisher bottle 10. Permanent securing can be accomplished by various known techniques including adhesive, tape, and mechanical locking tabs. In one embodiment, the sealing and the locking is performed with a double-sided, heat induction sealing foil 36. Thus, the foil 36 seals the replenisher bottle 10 closed and seals the keyed cover 22 to the bottle 10. The keyed cover 22 can be molded in colors to match the ink in the replenishing bottle 10 to provide an additional, visual confirmation that the correct bottle 10 is being used and that the correct cover 22 is being used when the bottles 10 are filled. A standard threaded cover 42 is screwed onto the neck 44 of the keyed cover 22 to prevent damage to the foil 36 during shipping and storage, as shown in FIG. 7.

When the replenisher bottle 10 is to be connected to the replenisher tube 12, the standard cover 42 is removed. The replenisher tube 12 is inserted into the replenisher bottle 10 through the keyed cover 22. If the replenisher bottle 10 and replenisher tube 12 mate, the external shape of the tube 12 will match and be received in the keyed opening 46 in the keyed cover 22, as best shown in FIG. 2. The end of the replenisher tube 12 is beveled to a relatively narrow point 48 to puncture the foil 36 and push the foil 36 out of the way of the tube 12 during insertion of the replenisher tube 12 into the replenisher bottle 10. Also, the fitting 26 will fit over and be screwed onto the neck 44 of the keyed cover 22 on the replenisher bottle 10. If the wrong bottle 10 is attempted to be placed on the tube 12, the tube 12 will only insert into the bottle 10 a short distance, $d_1$, shown in FIG. 2. This will not break the foil 36 and no color contamination will occur.

Figure 3:
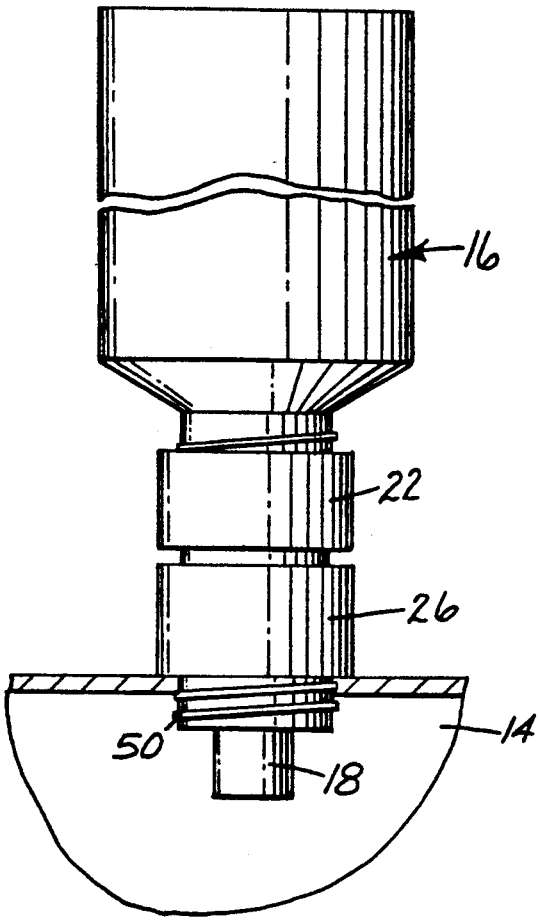
FIG. 3 is a side view of the bottle keying system of FIG. 1, with portions in section, showing the system used with concentrate bottles.
Figure 4:
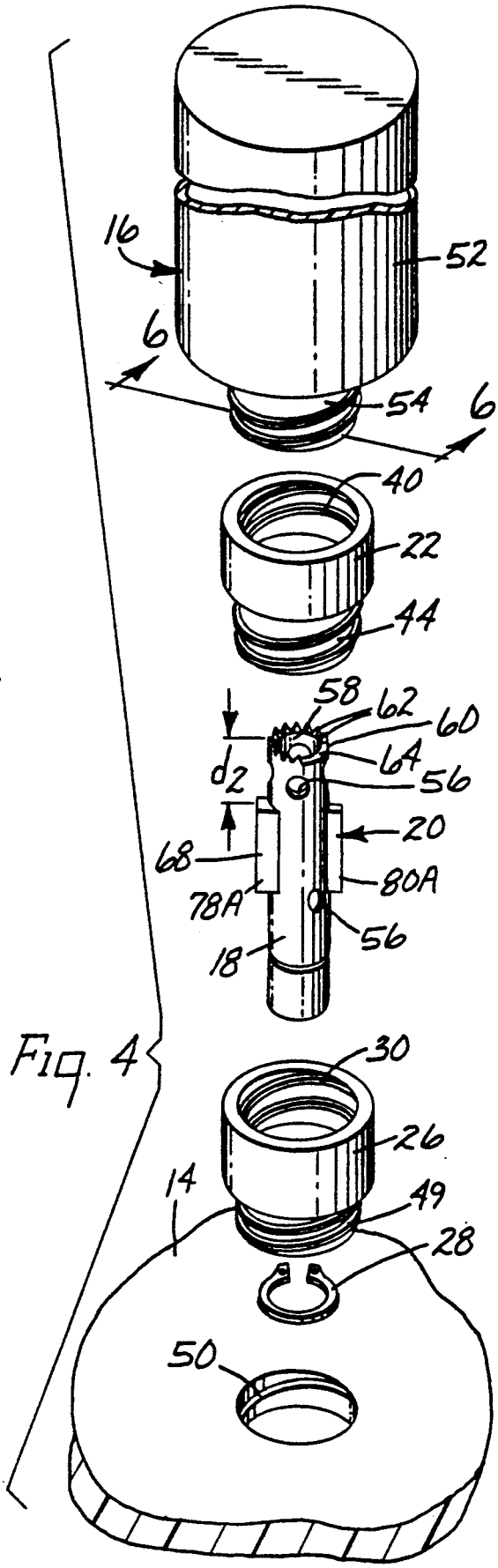
FIG. 4 is an exploded isometric view of the bottle keying system of FIG. 3.
Figure 5A:
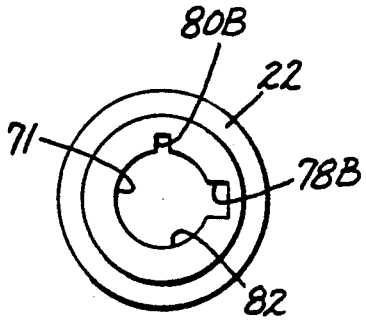
FIGS. 5A, 5B, 5C, 5D, 5E, and 5F are top views of the different keyholes used in one embodiment of the keying system of the present invention.
Figure 5B:
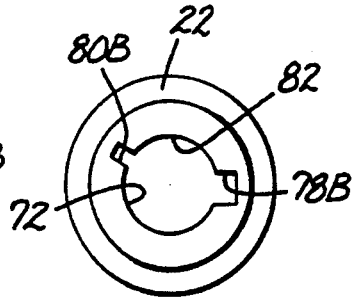
Figure 5C:
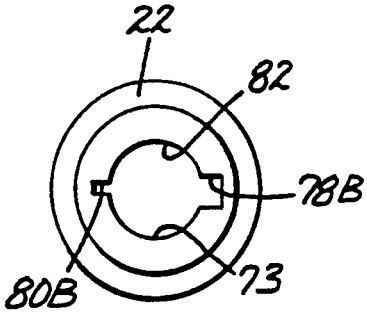
Figure 5D:
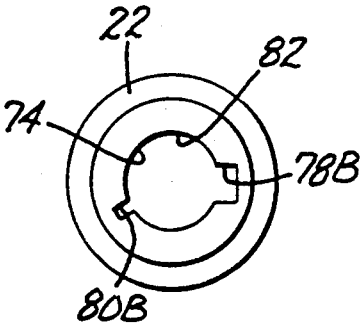
Figure 5E:
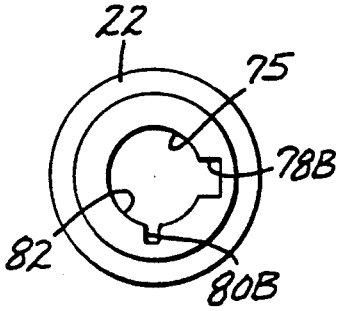
Figure 5F:
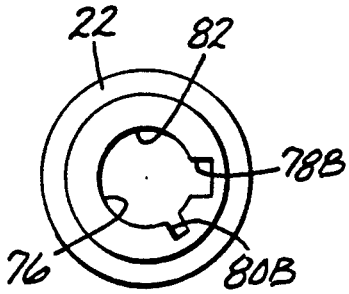

The concentrate system, as shown in FIGS. 3 and 4, is similar to the replenisher system. The concentrate tube 18 extends from and communicates with the tank 14, and preferably, is fixed to the tank 14 via the circular fitting 26. The circular fitting 26 is slid over and fixed on the concentrate tube 18 and is held in place by a retaining ring 28. The circular fitting 26 is screw threaded onto the tank 14 opening with threads 49 on the fitting 26 and threads 50 on the tank 14. The concentrate bottle 16 is smaller than the replenisher bottle 10 and includes a body 52 and a neck 54 and is filled with ink. A sealing foil 36 is placed across the opening at the top of the neck 54 to prevent contamination of the ink within and leakage of ink from the concentrate bottle 16 before the bottle 16 is used.

A keyed cover 22 is placed on and becomes an integral part of the neck 54 of the concentrate bottle 16 such that the keyed cover 22 can not be removed. The keyed cover 22 has screw threads 40 for further securing the cover 22 onto the threaded neck 54 of the concentrate bottle 16. Permanent securing can be accomplished by the methods described above with respect to the replenisher bottle 10. The keyed cover 22 also can be molded in colors to match the ink in the concentrate bottle 16. A standard cover 42 is screwed onto the neck 44 of the keyed cover 22 to prevent damage to the foil 36, as shown in FIG. 7.

When the concentrate bottle 16 is to be connected to the concentrate tube 18, the standard cover 42 is removed. The keyed cover 22 of the concentrate bottle 16 is placed over the concentrate tube 18. If the concentrate bottle 16 and concentrate tube 18 mate, the external shape of the tube 18 will be received in the keyed opening 46 in the keyed cover 22, and the concentrate bottle 16 will reach the internal threads 30 of the fitting 26. The fitting 26 will fit over and be screwed on the neck 44 of the keyed cover 22. If the wrong bottle 16 is attempted to be placed on the tube 18, the tube 18 will only insert into the bottle 16 a short distance, $d_2$ shown in FIG. 4, insufficient to break the foil 36 and cause color contamination.

Figure 6:
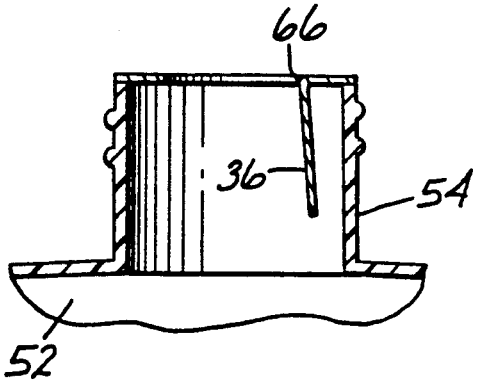
FIG. 6 is a cross-sectional view taken along line 6—6 of the concentrate bottle of FIG. 4.

Screwing the concentrate bottle 16 into the fitting 26 breaks the foil 36 and permits the ink to be drained into the tank 14. Holes 56 in the side of the concentrate tube 18 improve venting and permit the concentrate bottle 16 to drain completely. Due to the small clearances for the concentrate bottle 16, the concentrate tube 18 must be relatively short. Simply inserting the concentrate tube 18 into the concentrate bottle 16 can not guarantee that the foil 36 will be adequately broken and moved away from the concentrate tube 18 orifice 58. Thus, the circular edge 60 of the concentrate tube 18 is serrated 62 around most of the circumference to cut the foil 36. The unserrated portion 64 does not cut the foil 36 and permits the uncut portion of the foil 36 to serve as a hinge 66 around which the cut portion of the foil 36 bends out of the way of the orifice 58. This is shown in FIG. 6.

In the keying system 20, the tubes 12, 18 serve as male components, and keyed bottle covers 22 serve as female components. Different keys 68 are formed on the tubes 12, 18 and complementarily-shaped keyways 70 are formed on the keyed cover 22 for the bottles 10, 16. FIGS. 5A–5F illustrate the keyways for various colors. The respective keys (not shown) are complementarily shaped. A first key and keyway 71 are formed on a first tube-keyed cover pair which is used with magenta ink. A second key and keyway 72 are formed on a second tube-keyed cover pair which is used with cyan ink. A third key and keyway 73 are formed on a third tube-keyed cover pair which is used with yellow ink. A fourth key and keyway 74 are formed on a fourth tube-keyed cover pair which is used with black ink. Fifth and sixth additional keys and keyways 75, 76 are formed on fifth and sixth tube-keyed cover pairs, which are used with additional special inks, where these inks used.

Each key 68 and each keyway 70 include first projections 78A, 78B, respectively and second projections 80A, 80B, respectively, extending from a circular shape **82*a*, 82B. The first projection 78 is located in a reference position which is identical in all keys 68 and keyways 70. The second projection 80 is located a predetermined rotational distance from the reference position as measured from the center of the components. This distance for each tube-keyed cover pair is selected to identify the particular tube-keyed cover pair. As shown, the second projection 80 on any tube-keyed cover pair is located a multiple of 45° from the location of the first projection 78 as well as from the location of the second projection 80 on any other tube-keyed cover pair. In the illustrated embodiment, the first projection 78 is larger than the second projection 80. Alternatively, the shape of the first and second projections 78, 80** can differ or the projections can be identical.

The keyed covers 22 and fittings 26 can be designed such that they work with both the replenisher and concentrate systems. This reduces tooling and part costs. The replenisher and concentrate bottles 10, 16 can not be incorrectly interchanged even with identical keyed covers 22 and fittings 26 due to the sizes of the components and the geometry of the hardware within the printer. Although the foil 36 can be broken, such as when the concentrate bottle 16 is attempted to be mounted on the replenisher tube 12, the keying system 20 prevents cross-color contamination.

The keyed covers 22 can be used with existing replenisher and concentrate bottles 10, 16 to retrofit these bottles to prevent color contamination. As discussed above, the keyed covers 22 can simply thread onto the threaded necks 34, 54 of existing bottles 10, 16. The keyed cover 22 having a keyway 70 is placed on the neck 34, 54 of each bottle 10, 16, and a replenisher tube 2 1or concentrate tube 18, having a key 68, replaces the existing tube. A circular fitting 26 is fixed on each tube 12, 18, and is screw threadable onto the keyed cover 22 to secure together respective bottles 10, 16 with tubes 12, 18.

In molding the components of this keying system 20, the external shapes of the tubes 12, 18 can be changed simply by rotating a small rib around the outer diameter of the molding core pin or by changing the core pin. This allows the mold for the keyed cover 22 to have different inserts for the various keyways 70. Additionally, in alternative embodiments, the key 68 and keyway 70 can have any of various shapes such as triangles, rectangles, and other polygons as long as the shapes for a given color match each other but do not match the shape for any other color. Single projection keys 68 and keyways 70 also can be used.

Numerous characteristics, advantages, and embodiments of the invention have been described in detail in the foregoing description with reference to the accompanying drawings. However, the disclosure is illustrative only and the invention is not intended to be limited to the precise embodiments illustrated. Various changes and modifications may be effected therein by one skilled in the art without departing from the scope or spirit of the invention. For example, the keying system can be used with any type of containers where keying is necessary and can be used with solid and other substance delivery systems. Also, the keyed covers can be molded as one piece with the replenisher and concentrate bottles if no sealing foil is used.

I claim:

1. A keying system for insuring the proper placement of inks into the proper respective plumbing system of printing apparatus which use differently colored inks, wherein the printing apparatus includes an ink tank; a plurality of similarly-shaped replenisher bottles each having a threaded neck, one for each color, which dispense ink into the tank; and a plurality of replenisher tubes over which respective replenisher bottles are mounted which lead into the tank; the keying system comprising:

a key adapted to be formed on each replenisher tube;

a threaded keyed cover having a keyway adapted to be screw threaded on the neck of each replenisher bottle, where in the respective keys and keyways for each color are complementarily-shaped and are shaped differently from the keys and the keyways on other tubes and keyed covers, and wherein the keyed cover has a neck;

a circular fitting adapted to be fixed on the replenisher tube wherein the fitting is screw threaded onto the keyed cover to secure together the bottle and tube; and a standard cover adapted to be screw threaded onto the neck of the replenisher bottle keyed cover.

2. The keying system of claim 1 further comprising a sealing and locking foil adapted to be placed across the opening at the top of the neck of each replenisher bottle.

3. A keying system for insuring the proper placement of inks into the proper respective plumbing system of printing apparatus which use differently colored inks, wherein the printing apparatus includes an ink tank; a plurality of similarly-shaped concentrate bottles each having a threaded neck, one for each color, which dispense ink into the tank; and a plurality of concentrate tubes through which respective concentrate bottles dispense ink; the keying system comprising:

a key adapted to be formed on each concentrate tube;

a threaded keyed cover having a keyway adapted to be screw threaded on the neck of the concentrate bottle, wherein the respective keys and keyways for each color are complementarily-shaped and are shaped differently from the keys and the keyways on other tubes and keyed covers, wherein the keyed cover has a neck;

a circular fitting adapted to be slid over the concentrate tube wherein the fitting is screw threaded onto the keyed cover to secure together the bottle and tube; and a standard cover adapted to be screw threaded onto the neck of the concentrate bottle keyed cover.

4. The keying system of claim 3 further comprising a sealing and locking foil adapted to be placed across the opening at the top of the neck of each concentrate bottle.

5. The keying system of claim 4 wherein the printing apparatus further includes a plurality of similarly-shaped replenisher bottles each having a threaded neck, one for each color, which dispense ink into the tank; and a plurality of replenisher tubes over which respective replenisher bottles are mounted which lead into the tank; wherein the keying system further comprises:

a circular fitting adapted to be fixed on the replenisher tube;

a key adapted to be formed on each replenisher tube;

a threaded keyed cover having a keyway adapted to be screw threaded of the neck of each replenisher bottle, wherein the respective keys and keyways for each color are complementarily-shaped and are shaped differently from the keys and the keyways on other tubes and keyed covers;

a standard cover adapted to be screw threaded onto the neck of the replenisher bottle keyed cover; and a sealing and locking foil adapted to be placed across the opening at the top of the neck of each replenisher bottle.

6. A keying system for retrofitting on existing plumbing systems of printing apparatus which use differently colored inks, for insuring the proper placement of inks into the proper respective plumbing system, wherein the printing apparatus includes an ink tank; a plurality of similarly-shaped replenisher bottles each having a threaded neck, one for each color, which dispense ink into the tank; a plurality of replenisher tubes over which respective replenisher bottles are mounted which lead into the tank; a plurality of similarly-shaped concentrate bottles each having a threaded neck, one for each color, which dispense ink into the tank; and a plurality of concentrate tubes through which respective concentrate bottles dispense ink; the keying system comprising:

a replenisher tube for insertion into each replenisher bottle to provide a passageway for substance in the replenisher bottle to the plumbing system;

a key adapted to be formed on each replenisher tube;

a threaded keyed cover having a keyway adapted to be screw threaded on the neck of each replenisher bottle, wherein the respective keys and keyways for each replenisher tube-replenisher bottle pair are complementarily-shaped and are shaped differently from the keys and the keyways on other replenisher tubes and keyed covers such that the replenisher tube is receivable within only the respective replenisher bottle;

a circular fitting fixed on each replenisher tube, wherein the fitting is screw threaded onto the keyed cover to secure together the replenisher bottle and replenisher tube;

a concentrate tube for insertion into each concentrate bottle to provide a passageway for substance in the concentrate bottle to the plumbing system;

a key adapted to be formed on each concentrate tube;

a threaded keyed cover having a keyway adapted to be screw threaded on the neck of each concentrate bottle, wherein the respective keys and keyways for each concentrate tube-concentrate bottle pair are complementarily-shaped and are shaped differently from the keys and the keyways on other concentrate tubes and keyed covers such that the concentrate tube is receivable within only the respective concentrate bottle; and a circular fitting fixed on each concentrate tube, wherein the fitting is screw threaded onto the keyed cover to secure together the concentrate bottle and concentrate tube.

* * * * *

UNITED STATES PATENT AND TRADEMARK OFFICE

CERTIFICATE OF CORRECTION

PATENT NO. : 5,293,913

DATED : Mar. 15, 1994

INVENTOR(S) : Preszler

It is certified that error appears in the above-indentified patent and that said Letters Patent is hereby corrected as shown below:

Column 5, line 42, delete "21"
and insert --12--.

Signed and Sealed this

Fourth Day of October, 1994

*Attest:*

*Attesting Officer*

Bruce Lehman

BRUCE LEHMAN

*Commissioner of Patents and Trademarks*